US005361442A

United States Patent [19]

Payne et al.

[11] Patent Number: 5,361,442

[45] Date of Patent: Nov. 8, 1994

[54] POOL TILE SCRUBBER

[76] Inventors: Mark Payne; Amy Payne, both of 75 Akron Rd., Lake Worth, Fla. 33467

[21] Appl. No.: 151,101

[22] Filed: Feb. 4, 1994

[51] Int. Cl.[5] ..... E04H 4/16; B08B 9/36

[52] U.S. Cl. ..... 15/97.1; 15/1.7; 15/27; 15/28; 15/49.1; 15/160; 15/244.2

[58] Field of Search ..... 15/1.7, 27, 28, 49.1, 15/159.1, 160, 230, 244.1, 244.2, 97.1

[56] References Cited

U.S. PATENT DOCUMENTS 2,169,581 8/1939 Dadian ..... 15/28
2,748,412 6/1956 Peterson ..... 15/129
2,764,774 10/1956 Belsky ..... 15/228
5,142,724 9/1992 Park ..... 15/28

*Primary Examiner*—Edward L. Roberts
*Attorney, Agent, or Firm*—Alvin S. Blum

[57] ABSTRACT

A swimming pool scrubber has a handle adapted for receiving an extension handle. Attached at an angle to the handle is a ball. Rotatably mounted on the ball by a socket is a rubbery disc. Removably mounted on the front face of the disc is an abrasive cleaning pad with holes for a supply of cleaning compound. The disc has a high friction edge for rolling on the bottom of a swimming pool gutter while the pad is against the vertical wall of the gutter. The edge friction causes the pad to rotate as it moves along the wall for enhanced scrubbing action.

13 Claims, 1 Drawing Sheet

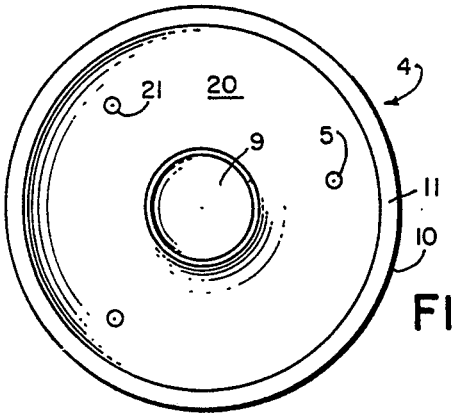
FIG. 2
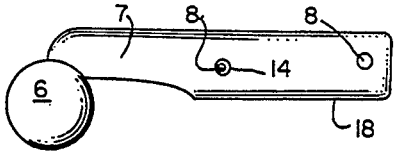
FIG. 3
FIG. 1
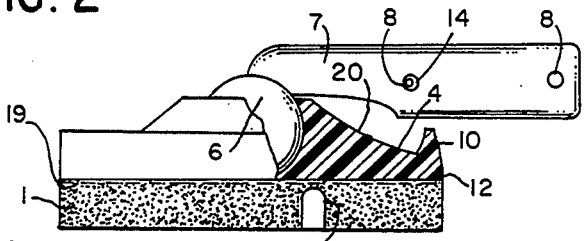
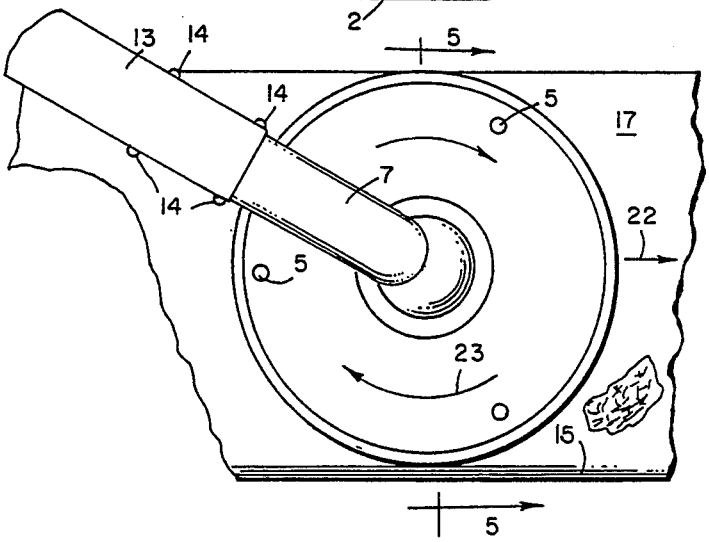
FIG. 4
FIG. 5
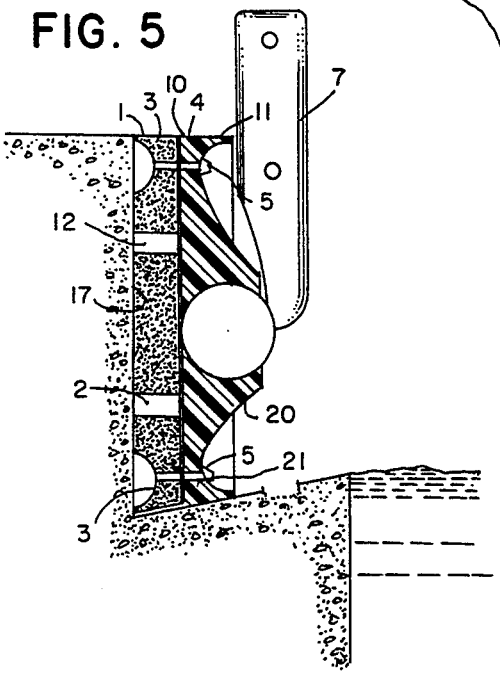

POOL TILE SCRUBBER

BACKGROUND OF THE INVENTION

This invention relates to devices for scrubbing surfaces, and more particularly to scrubbing apparatus having a flat, circular scrubbing surface on a disc attached to a handle by a ball and socket connection providing rotation of the scrubbing surface against a surface to be cleaned, when the edge of the disc is rubbed along an adjoining surface.

Swimming pools require regular cleaning of their walls. Underwater surfaces are cleaned by a vacuum attached to the filter system. Surface debris collects in a gutter where some is aspirated to the skimmer vacuum. Some debris collects and dries on the tile along the air-water interface in the gutter. This must be vigorously scrubbed off. It is a major time consuming and physically demanding task because of the awkward location below the level on which the worker is standing. The angles presented make it difficult to apply significant force to the usual back and forth scrubbing motions, required by conventional scrubbers.

The worker must also stop periodically to apply cleaning compound to the scrubber.

SUMMARY OF THE INVENTION

It is, accordingly, an object of the invention to provide a pool tile scrubber with a scrubbing action greater than that provided by simple back and forth motion of the scrubber against the surface to be cleaned. It is another object that the scrubber provide a prolonged source of cleaning compound. It is yet another object that the scrubber be usable at a variety of angles relative to the handle for less strenuous operation. It is yet another object that scrubbing element be replaceable when it becomes worn.

The scrubber of the invention comprises a handle with means for attaching an extending handle thereto. A sphere or ball extends from the handle transverse to the long axis of the handle. A rubbery disc with a flat front face has a socket molded into its rear face which receives the ball to rotatably mount the disc on the handle. The disc has a frictional perimeter arranged to be rubbed against the bottom of the pool gutter while the flat face of the disc is against the vertical gutter wall. An abrasive discoidal pad is removably mounted on the front face of the disc. This scrubs the vertical wall in a combined rotary and translatory motion as the scrubber is moved back and forth with the pad against the vertical wall and the perimeter of the disc frictionally engaging the bottom of the gutter, and causing it to rotate.

These and other objects, advantages and features of the invention will become more apparent when the detailed description is studied in conjunction with the drawings, in which:

BRIEF DESCRIPTION OF THE DRAWINGS

FIG. 1 is a side elevation view of the scrubber of the invention, partially broken away.

FIG. 2 is a rear view of the disc of the invention.

FIG. 3 is a side elevation view of the ball and handle.

FIG. 4 is a top view of the scrubber while scrubbing the vertical wall of a gutter.

FIG. 5 is a sectional view taken on line 5—5 of FIG. 4.

DETAILED DESCRIPTION OF PREFERRED EMBODIMENTS

Referring now first to FIGS. 1–3, a handle 7 has an elongate cylindrical portion 18 with hole 8 for spring loaded dentent pins 14. This type of handle is adapted for inserting into a long tubular extension handle well known in the swimming pool art. A ball or sphere 6 extends transversely from the handle. A rubbery disc 4 has a front face 19 on which is removably secured, by adhesive 12, an abrasive pad in a disc shape. The pad may be formed of a variety of materials as desired, such as, for example one of the non-woven abrasive fiber pads used for floor maintenance produced by the 3-M corporation and well known in the art. The rear face 20 of the disc is provided with a socket 9 which receives the ball 6. When so mounted, the disc is free to rotate about the ball when the perimeter 10 is rolled against a surface, such as the bottom of a gutter. The ball and socket joint also permits the handle to be held at various angles relative to the front face of the disc for enhanced positioning while standing at the side of the swimming pool, above the gutter. A series of apertures, or channels 2 are provided in the face of pad 1 for holding cleaning compound such as, for example, Tile soap TX-100 by TROP-CLEAR. When these channels are filled with cleaning compound, the operator can clean the wall of the gutter without stopping periodically to replenish the cleaning compound.

Various means for removably adhering the pad 1 to the front face 19 of disc 4 may be employed, such as the plastic push pins 5 shown in FIGS. 4 and 5. A series of through holes 3 are formed in the disc and in the pad for receiving push pins 5. These are plastic pins with a springy expanding end, well known in the fastener art.

They are pushed on from the pad end and through the disc where the end 21 expands to hold the pad in place. The disc is preferably made from a rubbery or elastomeric material so that the ball may be simply snapped in for ease of assembly. The rim or perimeter 10 must be of a high friction material so that it will roll, and not slide, against a surface. Polyyrethane elastomer has been found to provide the desired properties. The perimeter 10 is preferably provided with an extended rim 11 to provide a greater contact surface for enhanced rotary action. As best seen in FIGS. 4 and 5, when the pad 1 is forced against the vertical side wall 17 of the gutter and the perimeter 10 is rolled along the bottom 15 of the gutter in the direction of arrow 22, the pad and disc rotate about the ball as indicated by arrow 23. FIG. 4 shows the extension handle 13 on handle 7. As best seen in FIG. 5, the extended rim 11 of the disc, flexes so that the pad can reach the lowest portion of the wall 17. It is preferred that the rim 11 extend back from the front face at least past the center of the ball. This ensures that forces on the rim will tend to force the face of the disc against the wall and also provide increased perimeter friction for rotational action. Each translatory stroke with this device produces much greater surface motion of the pad than with a fixed pad.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A rotary scrubber for scrubbing a surface to be cleaned, said scrubber comprising:

A) a handle means having a long axis;

B) a ball attached to said handle means and extending therefrom at an angle transverse to said long axis;

C) a circular disc having a substantially flat broad front face, a perimeter, and a rear face;

D) a socket formed in said rear face, said socket receiving said ball for rotatably mounting said disc on said handle means, thereby providing said disc with an axis of rotation, said axis of rotation being adjustable to suit particular scrubbing situations;

E) said perimeter being provided with a frictional surface to thereby cause said disc to rotate when said perimeter is moved against a surface adjoining said surface to be cleaned;

F) a discoidal scrubbing means; and

G) holding means for holding said discoidal scrubbing means against said front face.

2. The scrubber according to claim 1, in which said holding means removably holds said scrubbing means against said front face.

3. The scrubber according to claim 2, in which said scrubbing means is an abrasive pad.

4. The scrubber according to claim 3, in which said pad is provided with apertures for holding cleaning compounds.

5. The scrubber according to claim 4, in which said holding means includes adhesive.

6. The scrubber according to claim 4, in which said holding means includes holding pins.

7. The scrubber according to claim 4, in which said disc is formed of an elastomeric material permitting snapping in of said ball in said socket and providing friction at said perimeter.

8. The scrubber of claim 7, in which said elastomeric material includes polyurethane.

9. The scrubber according to claim 4, in which said perimeter extends back from said front face to a plane which intersects said ball closer to said handle than the center point of said ball.

10. The scrubber according to claim 9, in which said handle means is provided with means for removably attaching a handle extension thereto.

11. A pad for a rotary scrubber for scrubbing the walls of swimming pools in which said scrubber includes:

a handle means having a long axis;

a ball attached to said handle means and extending therefrom at and angle transverse to said long axis;

a circular disc having a substantially flat broad front face, a perimeter, and a rear face;

a socket formed in said rear face, said socket receiving said ball for rotatably mounting said disc on said handle means, thereby providing said disc with an axis of rotation, said axis of rotation being adjustable to suit particular scrubbing situations;

said perimeter being provided with a frictional surface to thereby cause said disc to rotate when said perimeter is moved against a surface adjoining said surface to be cleaned; and holding means for removably holding to said front face a scrubbing pad, the improvement comprising:

a scrubbing pad formed of non-woven abrasive fibers, having broad opposed, parallel faces and a narrow circular edge;

a plurality of cleaning compound retaining channels extending from one of said parallel faces to the other of said parallel faces;

and attaching means cooperating with said holding means for removably attaching said pad to said front face.

12. The scrubbing pad of claim 11, in which said attaching means comprises a plurality of holes extending between said parallel faces in registry with corresponding holes in said disc for receiving removable retaining pins.

13. The scrubbing pad according to claim 11, in which said attaching means comprises adhesive means born by one of said parallel faces.

* * * * *